US011717930B2

(12) United States Patent
Grupp Mueller et al.

(10) Patent No.: US 11,717,930 B2
(45) Date of Patent: Aug. 8, 2023

(54) METHOD FOR SIMULTANEOUSLY CUTTING A PLURALITY OF DISKS FROM A WORKPIECE

(71) Applicant: Siltronic Corporation, Portland, OR (US)

(72) Inventors: Guenther Grupp Mueller, Portland, OR (US); James Mal, Portland, OR (US); Adam Marion, Beaverton, OR (US); Stan Meek, Portland, OR (US); James Mullins, Hillsboro, OR (US)

(73) Assignee: SILTRONIC CORPORATION, Portland, OR (US)

( * ) Notice: Subject to any disclaimer, the term of this patent is extended or adjusted under 35 U.S.C. 154(b) by 263 days.

(21) Appl. No.: 17/334,829

(22) Filed: May 31, 2021

(65) Prior Publication Data

US 2022/0379426 A1 Dec. 1, 2022

(51) Int. Cl.

| | |
|---|---|
| ***B24B 27/06*** | (2006.01) |
| ***B24B 51/00*** | (2006.01) |
| ***B24B 55/02*** | (2006.01) |

(52) U.S. Cl.

CPC ..... *B24B 27/0633* (2013.01); *B24B 51/00* (2013.01); *B24B 55/02* (2013.01)

(58) Field of Classification Search

CPC ..... B24B 27/0633; B24B 27/0675; B24B 27/0691; B24B 49/006; B24B 49/14; B24B 55/02; B24B 57/02; B28D 1/06; B28D 1/08; B28D 1/124; B28D 5/04; B28D 5/042; B28D 5/045; B28D 7/02

See application file for complete search history.

(56) References Cited

U.S. PATENT DOCUMENTS

| | | | | |
|---|---|---|---|---|
| 5,616,065 | A | 4/1997 | Egglhuber | |
| 5,810,643 | A | 9/1998 | Toyama | |
| 6,194,068 | B1 | 2/2001 | Ohashi et al. | |
| 6,279,564 | B1 | 8/2001 | Hodsden et al. | |
| 6,652,356 | B1 * | 11/2003 | Ariga | B28D 5/045 125/16.02 |
| 2009/0253352 | A1 * | 10/2009 | Oishi | B28D 5/0076 125/16.02 |

(Continued)

FOREIGN PATENT DOCUMENTS

| | | | |
|---|---|---|---|
| CN | 112297261 | A | 2/2021 |
| DE | 102012007815 | A1 | 10/2013 |

(Continued)

*Primary Examiner* — Joel D Crandall

(74) *Attorney, Agent, or Firm* — Leydig Voit & Mayer, Ltd.

(57) ABSTRACT

A method cuts semiconductor wafers. The method includes: cutting a semiconductor ingot into a workpiece; and sawing the workpiece into slices using a wire grid having a fixed abrasive grain wire, while moving workpiece towards the wire grid. At a first contact of the workpiece with the wire grid, an initial cutting speed is less than 2 mm/min, coolant flow is less than 0.1 l/h and a wire speed is greater than 20 m/s. The workpiece is then guided through the wire grid until a first cutting depth is reached, and then the coolant flow is increased to at least 2000 l/h. The cutting speed is reduced to less than 70% of the initial cutting speed between the first contact of the workpiece with the wire grid up to a cutting depth of half a diameter of the cylinder, and is then increased.

12 Claims, 5 Drawing Sheets

(56) References Cited

U.S. PATENT DOCUMENTS

| | | | | |
|---|---|---|---|---|
| 2010/0037881 | A1* | 2/2010 | Oishi | B28D 5/045 125/21 |
| 2012/0178346 | A1* | 7/2012 | Wiesner | B28D 5/0076 451/54 |
| 2013/0206126 | A1 | 8/2013 | Pietsch | |
| 2015/0314484 | A1 | 11/2015 | Pietsch | |
| 2017/0072594 | A1 | 3/2017 | Kato | |
| 2022/0234250 | A1 | 7/2022 | Pietsch et al. | |

FOREIGN PATENT DOCUMENTS

| | | | |
|---|---|---|---|
| DE | 102016224640 | A1 | 6/2018 |
| EP | 0799655 | A1 | 10/1997 |
| TW | 201336652 | A | 9/2013 |
| TW | 202015841 | A | 5/2020 |
| TW | 202042941 | A | 12/2020 |

* cited by examiner

400

METHOD FOR SIMULTANEOUSLY CUTTING A PLURALITY OF DISKS FROM A WORKPIECE

FIELD

The present invention relates to a method for simultaneously cutting a plurality of wafers from a semiconductor workpiece.

BACKGROUND

Many applications require a large number of similar wafers made of specific starting materials, for example glass wafers as substrates for the production of magnetic storage disks, wafers made of sapphire or silicon carbide as substrates for the production of optoelectronic components, or semiconductor wafers for the production of photovoltaic cells ("solar cells") or as substrates for the structuring of electronic, microelectronic or micro-electromechanical components. Wafers as substrates for electronic components or photovoltaic cells are also referred to as wafers.

The distance between the front and back sides of a disc is called the thickness of the disc, and the curvature of the central surface between the front and back sides is called the shape of the disc. Thickness and shape together form the geometry of the disc, with a particularly uniform thickness and a shape with low curvature corresponding to good geometry and a non-uniform thickness and highly curved shape corresponding to poor geometry. For demanding applications, disks preferably have a particularly good geometry. The difference between the maximum and minimum values of thickness encountered during a scan pattern or series of point measurements is defined as the total thickness variation ("TTV", e.g., according to ASTM F657, the entire contents of which is hereby incorporated by references herein).

The starting material from which the slices are cut is usually in the form of a cylindrical bar (a "workpiece"). A cylinder is bounded by a flat base surface, a top surface, and a lateral surface. The base and top surfaces are also referred to as end faces.

The separation of slices from a workpiece is performed by breaking up the material cohesion along separation planes. For a large number of uniform flat slices, the parting surfaces are preferably flat, perpendicular to the workpiece axis, and adjacent parting planes are preferably equally spaced. Material cohesion is usually broken by chip-removing processes. A chip is defined as a particle detached from the workpiece. The volume of material removed along a parting line by chip removal is called the parting gap (or separating, cut-off, saw, or cutting gap). For certain applications, the parting gaps can also deviate from the perpendicular to the workpiece axis by small angles, for example up to 2°.

Among the chip-removing processes for cutting a workpiece into a plurality of uniform, thin slices of particularly uniform thickness and particularly low curvature of their shape, wire cutting (wire sawing) is of particular importance.

The saw wire used to rip a bar is made, for example, of hardened steel (e.g., piano wire), plastics, carbon fibers, or metal alloys. The wire may comprise one element (i.e., monofilar wire) or be stranded from several elements, which may also comprise different materials. Saw wires for use in wire saws are disclosed, for example, in EP 0 799 655 A1, U.S. Pat. No. 6,194,068 B1 or DE 10 2012 007 815 A1, the entire contents of each of which are hereby incorporated by reference herein.

For example, diamond wires are sawing wires coated with fine diamond cores as an abrasive. A diamond saw wire is disclosed, for example, in U.S. Pat. No. 6,279,564 B1, the entire contents of which is hereby incorporated by reference herein. This diamond wire is hence also referred to as fixed abrasive grain wire.

For saw wires whose surface is covered with abrasives, a liquid cutting agent without abrasives is preferably used, in the simplest case water.

The present inventors have recognized that there are several advantages for the using of a diamond wire. Consider, for example, that slurry-based wire sawing can be slow when cutting very hard materials like silicon. Diamond wire, on the other hand, offers substantial improvements in speed, thus increasing productivity.

The coolant required for cutting is primarily water, with a small amount of surfactant added. This makes for easy set up, and also makes it easy to reclaim material lost during the cutting process.

During a wire cutting operation, the saw wire occasionally breaks. A wire break can be caused, for example, by excessive wire friction in the cut-off gap and a resulting excessive wire tension between the wire guide rollers, or by defects in the wire itself, for example in the form of inclusions or due to excessive wear.

A wire break leads to an interruption of the wire cutting operation. In most cases, in order to repair the broken wire, the partially sawn workpiece must be completely moved out of the wire creel. After the wire creel has been repaired, the workpiece must first be moved back into the wire creel in such a way that exactly one wire section is located in each cutting gap, and then fed-in exactly perpendicular to the plane of the wire creel—and without moving the wire creel in the direction of the workpiece axis—until the wire creel has again come to rest in the workpiece at the location where the cut was interrupted.

When using diamond wires (e.g., fixed abrasive grain wires), a complete removal of the saw wire, including possible diamond splinters from the affected saw gap, is not possible. This is because, after the repair of the wire gate and the refeeding of the wire sections into the individual saw gaps, the saw wire in the same saw gap breaks again immediately after the restart. This new break in the diamond saw wire is attributed to remnants of the saw wire and/or broken diamond chips in the saw gap affected by the wire break.

It is known that the use of a fluid cooling or cutting agent like water is essential to prevent a wire break. Moreover, DE10 2016 224 640 A1 teaches that the fluid cutting agent used should be ejected at increased pressure from the outlet opening of a nozzle in the direction of the saw gaps. The increased pressure is advantageous, in particular to remove the smallest diamond particles that get caught in the saw gap, thus reducing the risk of wire breakage.

To reduce kerf-loss and thus increase productivity, the present inventors have recognized that there is the need to introduce saw wires with a significantly smaller diameter (e.g., less than 140 μm) leading to a smaller gap between the wafers during cutting and thus increase the risk for a wire breakage. However, a worsening of the geometry parameters (e.g. increase in total thickness variation (TTV)) can be observed while doing so.

US 2017/0072594 A1, the entire contents of which are hereby incorporated by reference herein, exhibits that the abrasive grain density on the wire has a strong influence of the geometry of the sliced wafer and thus the geometry (TTV) improves.

Regardless, in certain areas of the wafer, the present inventors have recognized that the TTV is still underperforming using a fixed abrasive wire. These areas can be identified as the areas where the wire meets the workpiece first. These geometric flaws must be removed in a later step of the production chain of the semiconductor wafer, which is expensive and sometimes not possible easily.

SUMMARY

In view of the above, the present disclosure provides a reliable method for cutting wafers from a silicon ingot, which does not exhibit a worsening of the geometry parameters, while using a thin diamond cutting wire and at the same time profiting from the fast cutting speed of diamond wires.

According to a first aspect of the present disclosure, a method of cutting semiconductor wafers is provided. The method includes: providing a semiconductor ingot in the shape of a cylinder; cutting the semiconductor ingot into a workpiece using a saw; and sawing the workpiece into slices using a wire grid comprising a fixed abrasive grain wire guided around two rollers. The rollers have grooves in which the fixed abrasive grain wire is guided. During the sawing, the workpiece is moved towards the wire grid. At a first contact of the workpiece with the wire grid, an initial cutting speed $v_{start}$ is less than 2 mm/min, at the same time a coolant flow is less than 0.1 l/h, and at the same time a speed of the fixed abrasive grain wire $v_w$ is greater than 20 m/s. After the first contact, the workpiece is guided through the wire grid until a first cutting depth of at least 7 mm is reached. During the sawing, the coolant flow remains constant until the first cutting depth is reached, and is then increased to at least 2000 l/h. The cutting speed is reduced to less than 70% of the initial cutting speed between the first contact of the workpiece with the wire grid up to a cutting depth of half a diameter of the cylinder and is then increased.

The semiconductor wafers may be semiconductor wafers of monocrystalline silicon, the semiconductor ingot may be a monocrystalline single crystal of silicon, the workpiece may be a crystal workpiece having a length between 350 mm and 450 mm, and the saw may be a band saw.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

According to an embodiment of the present invention, a method is provided for simultaneously cutting a plurality of disks from a workpiece. According to a preferred embodiment, the workpiece is a semiconductor workpiece, in particular a semiconductor crystal, and a thin diamond cutting wire is used for the simultaneous cutting of the disks.

In an embodiment, a method is provided for cutting semiconductor wafers of monocrystalline silicon. The method includes: (1) providing a monocrystalline single crystal of silicon in the shape of a cylinder; (2) cutting the monocrystalline silicon single crystal into a crystal workpiece having a length between 350 mm and 450 mm by means of a band saw; and (3) sawing the crystal workpiece into slices by means of a wire grid composed of a fixed abrasive grain wire guided around two rollers containing grooves in which the fixed abrasive grain wire is guided. During the performance of the method, the crystal workpiece is moved towards the wire grid, and at the first contact of the crystal workpiece with the wire grid, the initial cutting speed $v_{start}$ is less than 2 mm/min, at the same time the coolant flow is less than 0.1 l/h, and at the same time the speed of the wire used $v_w$ is greater than 20 m/s. After the first contact, the crystal piece is guided through the wire grid until a cutting depth of at least 9 mm is reached, the coolant flow remaining constant up to this point, and then increased to at least 2200 l/h. The cutting speed is reduced to less than 70% of the initial cutting speed between the first contact of the crystal piece with the wire grid up to a cutting depth of half the diameter of the cylinder and is then increased again.

The method according to the present invention provides a reliable means for cutting wafers from a silicon ingot, which does not exhibit a worsening of the geometry parameters, while using a thin diamond cutting wire and at the same time profiting from the fast cutting speed of diamond wires.

Figure 1:
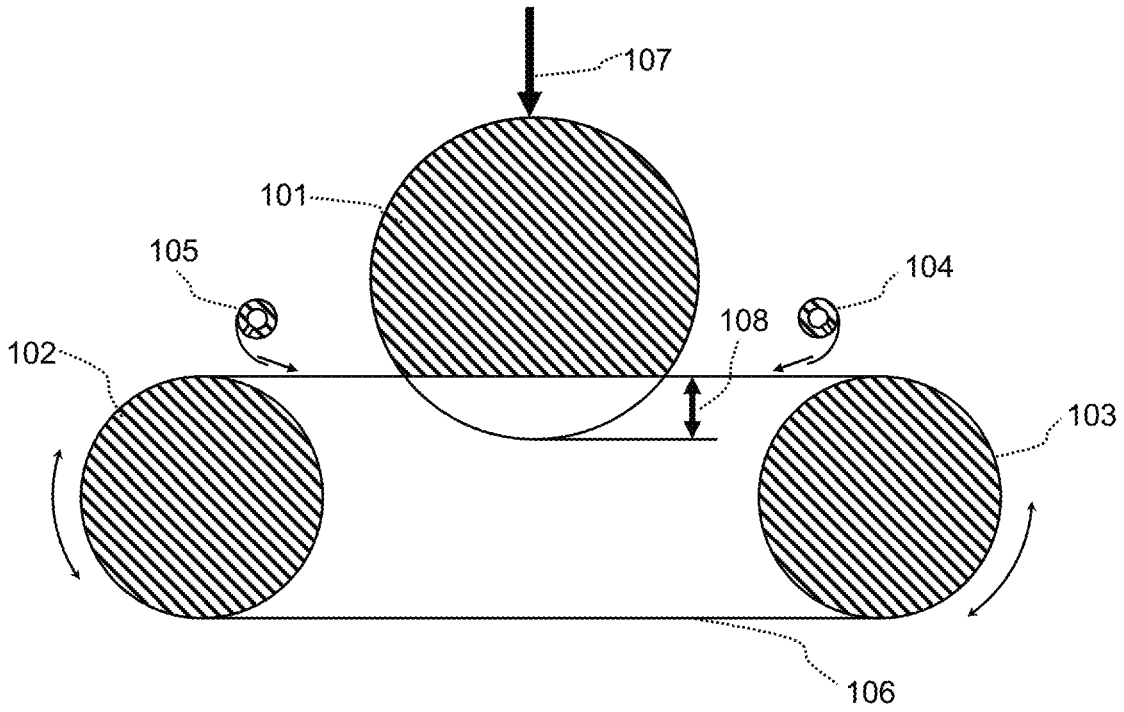
FIG. 1 shows a setup for a wire saw configured to saw a workpiece.

FIG. 1 shows a wire saw configured to saw a workpiece. In FIG. 1, the workpiece is a crystalline ingot 101 having a diameter D and a length L. A wire web 106 is formed by spanning a fixed-abrasive-grain wire over a first grooved roller 102 and a second grooved roller 103.

The wire can be supplied with a coolant, which mainly comprises water over a first spray nozzle 104 and/or a second spray nozzle 105. While cutting, the crystalline ingot 101 is moved through the wire web in a direction 107, which is perpendicular to the wire web. The progress of the cut can be measured with the distance $d_c$ 108.

In an attempt to successfully exploit economic and environmental benefits associated with using diamond wires to cut semiconductor wafers from an ingot, the present inventors have found that the total thickness variation (TTV) of the cut wafers did not meet the requirements of the semiconductor industry.

The present inventors, therefore, set to provide an improved cutting method that meets or exceeds the requirements of the semiconductor industry. To this end, several monocrystalline ingot pieces having a length of between 350 mm and 450 mm where cut. Experiments were made using a wire thickness of 70 μm and 100 μm. The grain density of the wire was chosen to be more than 1000 grains/mm$^2$.

The total thickness variation (among other values) of the wafers was measured (according to ASTM F657) after cutting.

In addition, a slightly modified method was used to evaluate a localized total thickness variation of the wafers as a function of the cutting depth. For this purpose, an ingot piece was cut from a monocrystalline ingot with a band saw. This ingot piece was then cut into wafers using a multiwire saw. Each wafer was measured according to the measurement method as described above.

Figure 2:
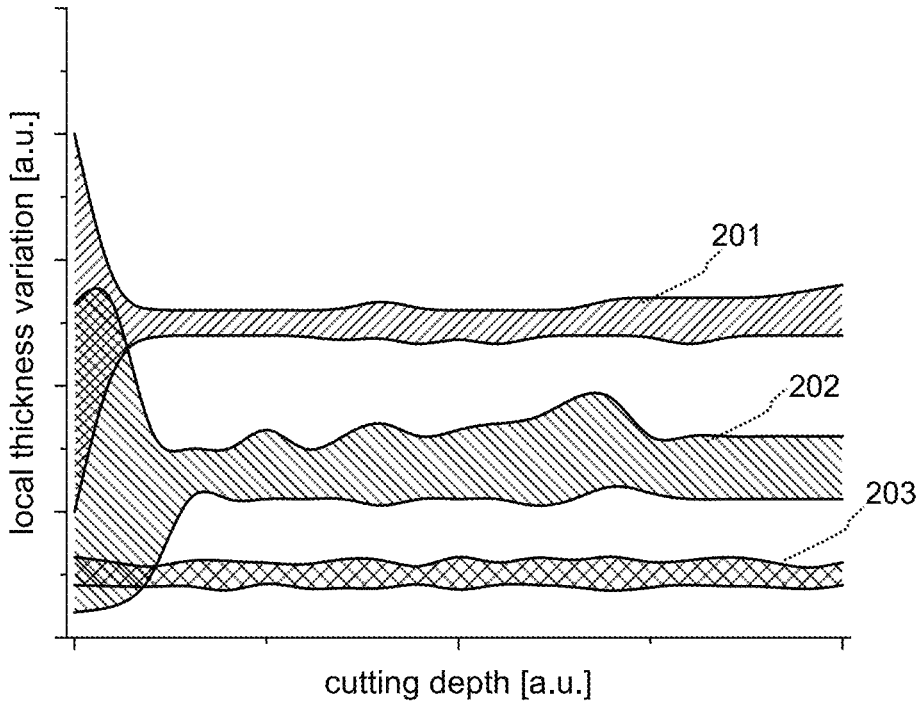
FIG. 2 shows schematically three groups of results of different process conditions (with respect to a localized thickness variation.

FIG. 2 schematically exhibits the basic results of these measurements.

In particular, FIG. 2 shows schematically three groups of results of different process conditions (201, 202 and 203) with respect to a localized thickness variation. The localized thickness variation (given in arbitrary units, a. u.) is plotted as a function of the cut in depth (in arbitrary units). FIG. 2 demonstrates that the three groups differ significantly both in an average level and in a local deviation from the local average.

Each ingot piece was cut into a group of semiconductor wafers. Each group of semiconductor wafers then results in a band containing the values of the localized thickness change measurement as a function of cutting depth. Following the abscissa from left to right increases the depth of cut achieved.

As shown in FIG. 2, the first group 201 of wafers (cut from a first ingot piece) exhibits higher average localized thickness values as compared to the second group 202 and the third group 203.

It is noticeable that especially at the beginning of the cut the variation of the localized thickness of the wafers is rather high for the first group 201 and the second group 202 compared to the third group 203.

It is also noticeable that the wafers of the second group 202 exhibit a broader band of the localized thickness variation and the thickness of the band varies with increasing cutting depth.

Based on this experimental data, the present inventors concluded that wafers exhibiting measurement values as shown in the third group 303 are most desirable.

Figure 3:
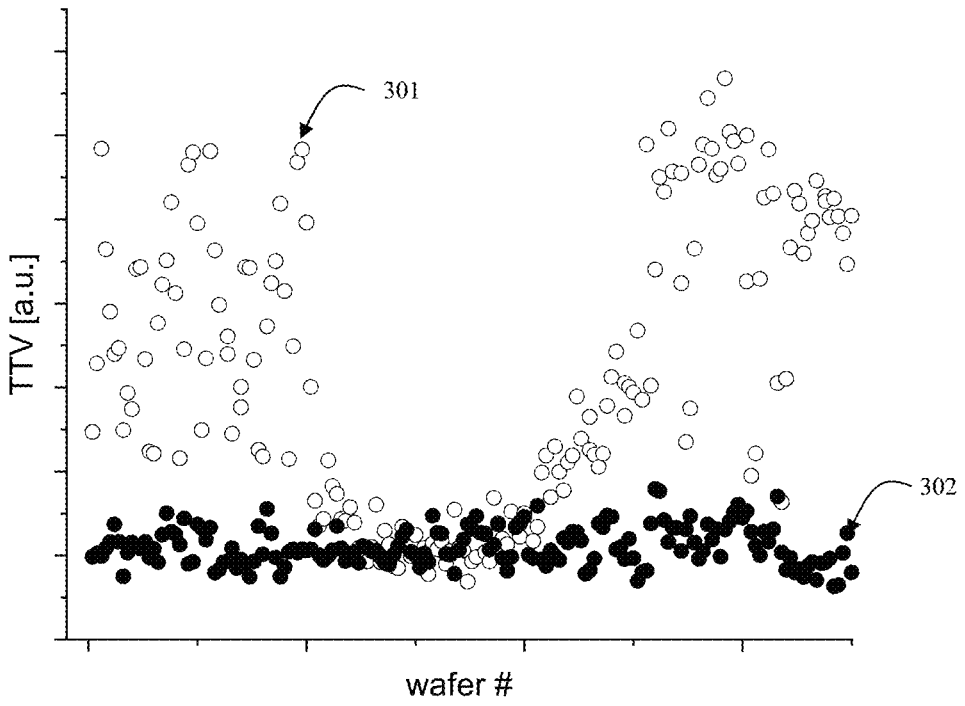
FIG. 3 shows result of measuring a total thickness variation of wafers taken from two different ingot pieces.

FIG. 3 exhibits the result of the measurement of the total thickness variation (according to ASTM F657) of wafers taken from two different ingot pieces.

Each TTV value is plotted against its wafer position (wafer #) in the corresponding ingot piece. The plot uses arbitrary units of measurements for simplicity and a qualitative comparison.

The measurement of the first group of wafers 301 (shown with the open circles) demonstrate significant scattering towards the ends of the crystal piece. Whereas, in the middle, the scattering and the average values appear rather low.

In contrast, the measurement of the second group of wafers 302 (shown with solid circles) exhibits both, low values in TTV and at the same time low scattering between wafer and wafer which is very desirable.

The inventors realized that, during the sawing process, both the location of the semiconductor wafer in the crystal piece and the respective depth of cut has an effect on the thickness variance (TTV) while using a diamond wire for cutting.

Ryningen et al. (B. Ryningen, P. Tetlie, S. G. Johnsen et al., "Capillary forces as a limiting factor for sawing of ultrathin silicon wafers by diamond multi-wire saw," Engineering Science and Technology, an International Journal. available at: doi.org/10.1016/j.jestch.2020.02.008, the entire contents of which is hereby incorporated by reference herein) suggest by following their parameter study and theoretical aspects that capillary forces have an important influence of TTV while using diamond wires to cut polysilicon wafers. To solve the problem, they suggest either performing a dry cut-in or (the opposite) using a fully immersed wire web for cut-in.

Although Ryningen et al. suggest omitting the coolant at the beginning of cutting to achieve some effect on the TTV value, their proposal fails to ensure local thickness variance across the entire semiconductor wafer. Especially for semiconductor wafers originating from the edges of the crystal piece, the TTV value deviates strongly from the corresponding average value (as for example shown in FIG. 3, open circles 301).

Moreover, the absolute numbers of the achieved TTV is too large to be suitable for producing semiconductor wafers for the semiconductor industry. Ryningen et al. do not propose a solution to this problem, nor do they give any indication of how this problem might be solved.

Figure 4:
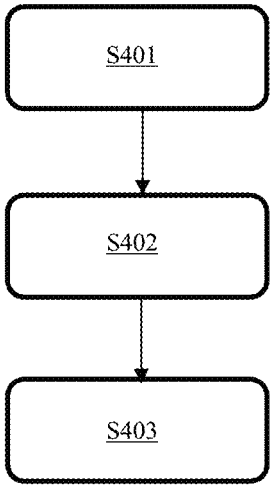
FIG. 4 illustrates an embodiment of a method according to the present invention.

To solve the above-mentioned problems, the inventors have provided a method for cutting semiconductor wafers of monocrystalline silicon, which is advantageous over what is known. FIG. 4 is a flow diagram of a method 400 according to an embodiment of the present invention.

In the method 400, a semiconductor ingot is provided (S401). The semiconductor ingot is preferably a monocrystalline single crystal of silicon in the shape of a cylinder. After crystal growth, the crystal has a cone at each ends of the crystal which are typically cut off by using a band saw. Furthermore, the crystal shows surface undulations, which are caused by variations of thermal conditions during crystal growth. These undulations are eliminated by cylindrical grinding, resulting in a round cylinder with a smooth mantle surface.

The semiconductor ingot (e.g., the monocrystalline silicon single crystal) is cut into a workpiece (e.g., a crystal workpiece) (S402). In a preferred embodiment the workpiece (e.g., the crystal workpiece) has a length between 350 mm and 450 mm. The cut may be made by means of a saw (e.g., a band saw). The semiconductor ingot (e.g., the single crystal) is cut into workpieces (e.g., crystal workpieces) due to several reasons: (1) Wire saws are not capable of sawing very long ingots; and even if so (2) during crystal growth, quality parameters of the crystal change with increasing length. So, it is usually beneficial to select parts of the crystal for special customer needs.

The workpiece (e.g., crystal workpiece) is cut into slices (S403. In particular, the workpiece is cut by a wire grid (wire web or wire mesh). The wire grid may be composed of a fixed abrasive grain wire guided around two rollers containing grooves in which the sawing wire is guided. The workpiece (e.g., the crystal workpiece) is moved towards the wire grid. A fixed abrasive grain wire can be understood as a wire where the abrasives are fixed on the surface of the wire. For example, diamond wires are a variant of these class of sawing wires. Preferably, a distance between two grooves on the roller is not less than 769 μm and not more than 850 μm.

Additionally, preferred embodiments comply with the following settings during operation of the method.

At the first contact of the workpiece (e.g., the crystal workpiece) with the wire web, i.e. the beginning of sawing, the initial cutting speed $v_{start}$ is preferably the highest value during the cut. Preferably, $v_{start}$ is not less than 1.4 mm/min.

Most preferably, the cutting speed during the cut is a function of the cutting depth following a parabolic line having the low point in the middle of the cut (half the diameter of the crystal piece) which has a value of 70% of $v_{start}$.

Preferably, the coolant flow is set at the beginning of the cut to less than 0.1 l/h until a cutting depth of at least 7 mm and at most 13 mm is reached. The coolant flow is then set to a value of more than 2000 l/h, particularly preferably more than 2200 l/h. Preferably, the coolant contains water and a surfactant. Most preferably, loose grains in the coolant are not intended to be used. The inventors realized that there are geometry issues at lower cutting depths than 7 mm and that there are issues still prevalent with TTV at higher cutting depth than 13 mm. This effect was present with both using a 70 μm and a 100 μm wire.

In the performance of the method, it is preferred that the speed of the wire $v_w$ is to be set greater than 20 m/s while beginning with the cut.

Preferably, the direction of the wire speed is alternated during the cut and therefore it is preferred that the maximal speed is matched during the beginning of the cut. This method is also called pilgrim method and thus the length of the wire is called "pilgrim length". Most preferably, the maximum length of the wire traveling in one direction (pilgrim length) is more than 850 m before the direction is changed. Most preferably, the maximum length of the wire traveling in one direction. A graphic representation of this method can be seen in FIG. 5. Most preferably the minimum pilgrim length during the cut is not more than 98.5% of the initial pilgrim length.

Figure 5:
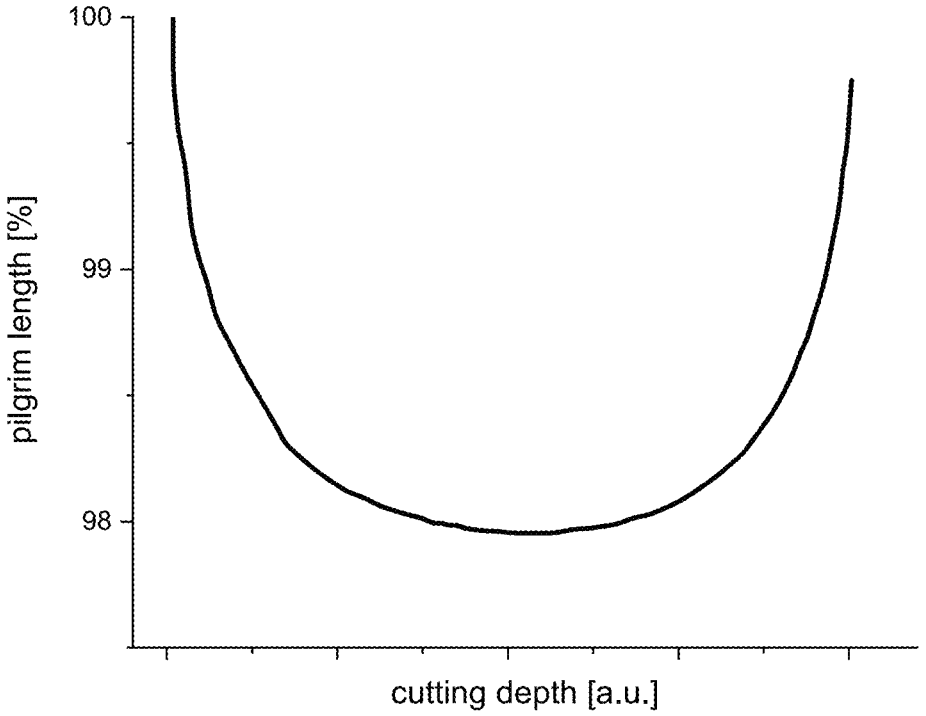
FIG. 5 shows a length of wire transported in one direction before the direction of the wire's speed is reversed.

FIG. 5 shows the length of wire (in relative units) transported in one direction before the direction of the wire's speed is reversed. This method is also called pilgrim method and thus the length of the wire is called "pilgrim length". The graph shows that this pilgrim length first decreases and then increases again with increasing depth of cut. In the graph the minimum pilgrim length is about 98% of the initial pilgrim length.

Preferably, the thickness of the sawing wire used is not more than 80 μm and not less than 60 μm.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

DESCRIPTION OF THE REFERENCE NUMERALS

101 Semiconductor ingot having a diameter D and a length L
102 First grooved roller
103 Second grooved roller
104 First spray nozzle
105 Second spray nozzle
106 Wire web formed by a fixed-abrasive grain wire
107 Direction of the movement of the ingot towards the sawing wire web
108 Cutting distance dc

What is claimed is:

1. A method of cutting semiconductor wafers, the method comprising:

providing a semiconductor ingot in the shape of a cylinder;

cutting the semiconductor ingot into a workpiece using a saw; and sawing the workpiece into slices using a wire grid comprising a fixed abrasive grain wire guided around two rollers, the rollers having grooves in which the fixed abrasive grain wire is guided, wherein during the sawing, the workpiece is moved towards the wire grid, wherein at a first contact of the workpiece with the wire grid, an initial cutting speed $v_{start}$ is less than 2 mm/min, at the same time a coolant flow is less than 0.1 l/h, and at the same time a speed of the fixed abrasive grain wire $v_w$ is greater than 20 m/s, wherein after the first contact, the workpiece is guided through the wire grid until a first cutting depth of at least 7 mm is reached, wherein, during the sawing, the coolant flow remains constant until the first cutting depth is reached, and is then increased to at least 2000 l/h, and wherein the cutting speed is reduced to less than 70% of the initial cutting speed between the first contact of the workpiece with the wire grid up to a cutting depth of half a diameter of the cylinder and is then increased.

2. The method according to claim 1, wherein the semiconductor wafers are semiconductor wafers of monocrystalline silicon, wherein the semiconductor ingot is a monocrystalline single crystal of silicon, wherein the workpiece is a crystal workpiece having a length between 350 mm and 450 mm, and wherein the saw is a band saw.

3. The method according to claim 2, wherein a thickness of the fixed abrasive grain wire is not more than 80 μm and not less than 60 μm.

4. The method according to claim 2, wherein the fixed abrasive grain wire comprises a core wire and abrasive grains fixed on a surface of the core wire.

5. The method according to claim 2, wherein the coolant flow comprises water and a surfactant.

6. The method according to claim 2, wherein the grooves of the rollers have a distance between each other not less than 769 μm and not more than 850 μm.

7. The method according to claim 2, wherein a direction of the wire speed is alternated during the cut.

8. The method according to claim 1, wherein the fixed abrasive grain wire is a diamond wire.

9. The method according to claim 1, wherein the cutting speed during the sawing is a function of the cutting depth following a parabolic line in a middle of the cut, which is at the cutting depth of half the diameter of the cylinder.

10. The method according to claim 1, wherein the first cutting depth is at least 9 mm.

11. The method according to claim 1, wherein the first cutting depth is at most 13 mm.

12. The method according to claim 1, wherein upon reaching the first cutting depth, the cooling flow is increased to at least 2200 l/h.

* * * * *